United States Patent [19]

Paraskos et al.

[11] 4,133,740

[45] Jan. 9, 1979

[54] PROCESS FOR INCREASING THE FUEL YIELD OF COAL LIQUEFACTION PRODUCTS BY EXTRACTION OF ASPHALTENES, RESINS AND AROMATIC COMPOUNDS FROM SAID COAL LIQUEFACTION PRODUCTS

[75] Inventors: John A. Paraskos, Pittsburgh, Pa.; Edward W. Smith, Houston, Tex.

[73] Assignee: Gulf Research & Development Company, Pittsburgh, Pa.

[21] Appl. No.: 844,456

[22] Filed: Oct. 21, 1977

[51] Int. Cl.[2] ..... C10G 1/04

[52] U.S. Cl. ..... 208/8; 208/314; 208/336

[58] Field of Search ..... 208/8, 314, 336

[56] References Cited

U.S. PATENT DOCUMENTS

| | | | |
|---|---|---|---|
| 2,871,181 | 1/1959 | Kulik | 208/8 |
| 3,583,900 | 6/1971 | Gatsis | 208/8 |

*Primary Examiner*—Herbert Levine

[57] ABSTRACT

A process for increasing the fuel yield of coal liquefaction products by extracting the asphaltenes, resins and aromatic compounds from said coal liquefaction products. This is accomplished by contacting said coal liquefaction products with a halogenated aliphatic solvent to form two phases, one containing tar and the other containing said solvent and the remainder of said coal liquefaction products, separating said phases from each other and treating said tar phase with a second solvent to recover asphaltenes, resins and/or aromatics in said tar phase. The resulting asphaltenes, resins and/or aromatics are suitable for upgrading to produce additional synthetic fuel.

14 Claims, 1 Drawing Figure

PROCESS FOR INCREASING THE FUEL YIELD OF COAL LIQUEFACTION PRODUCTS BY EXTRACTION OF ASPHALTENES, RESINS AND AROMATIC COMPOUNDS FROM SAID COAL LIQUEFACTION PRODUCTS

BACKGROUND OF THE INVENTION

1. Field of the Invention

Coal represents approximately 84 percent of the known recoverable fossil fuel resources in the United States; while petroleum and natural gas account for about 10 percent and shale oil for the remaining 6 percent.

The shrinking petroleum and natural gas reserves around the world, and recently enacted governmental sulfur oxides emission standards in the United States, have capsuled the need to focus attention on coal conversion technology and the production of synthetic fuels therefrom to meet the growing demand for energy in the United States and around the world. However, in the production of synthetic fuel, a substantial portion of the fuel is lost in the separation phase, particularly the phase wherein, tar and solid particles are separated therefrom. Normally, during the separation step of a coal liquefaction process, asphaltenes, resins and aromatics are separated along with the tar from the synthetic fuels. Upgrading of the tar product to produce additional synthetic fuel is difficult because the asphaltenes hinder access of the product to catalyst surface normally utilized in an upgrading process. Accordingly, it is desirable to remove the asphaltenes, resins and aromatics from the tar products and subject them to conventional cracking processes before the upgrading step in the process to increase the yield of synthetic fuel which would otherwise not be recovered from the tar products. In the present process, the coal liquefaction products are contacted with a halogenated aliphatic solvent, defined more specifically hereinafter.

2. Description Of The Prior Art.

The separation of dispersed solids from organic liquids, for example hydrocarbons; is known and appreciated in the prior art. For example, in the conversion and upgrading of solid carbonaceous materials (i.e. coal, etc.) into liquid hydrocarbons, tremendous quantitites of the hydrocarbons are produced which contain unreacted coal, ash particles and the like. One method of removing dispersed solids from organic liquids is disclosed in U.S. Pat. No. 3,563,885, entitled Removal of Dispersed Solids From A Liquid, issued to Talbot, on Feb. 16, 1971. The reference relates to the removal of dispersed solids from organic liquids by adding a small quantity of ultra high molecular weight polyethylene under agitation and at an elevated temperature to the liquid. The mixture is allowed to cool until the polyethylene containing the dispersed solids coagulates. The coagulated material is next removed by conventional techniques.

Another approach for separating liquid hydrocarbons from mineral solids is set forth in U.S. Pat. No. 3,941,679, entitled Separation of Hydrocarbonaceous Substances From Mineral Solids, issued to Smith et al, on Mar. 2, 1976, which discloses a method for separating liquid hydrocarbons from the mineral solids of tar sands, oil shales and similiar geological composites. In particular, liquid trichlorofluoromethane is used to dissolve and extract the hydrocarbons from the mineral solids. The references fail, however, to disclose or suggest a process for increasing the yield of synthetic fuels produced from a coal liquefaction process by extracting asphaltenes, resins and aromatic compounds from tar and solid particles previously separated from the coal liquefaction products and upgrading the extracts to produce additional fuel.

SUMMARY OF THE INVENTION

A process for increasing the yield of liquid synthetic fuel in a coal liquefaction process which comprises forming a mixture by blending a coal liquefaction product with a halogenated aliphatic solvent of the formula:

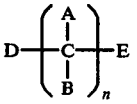

wherein n is an integer of from about 1 to about 20, preferably from about 1 to about 10; and wherein A, B, D and E are either alike or different, members selected from the group consisting of hydrogen, chlorine, bromine or fluorine and mixtures thereof, with the provision that at least one of said A, B, D or E is chlorine, bromine or fluorine; allowing the mixture to separate into an upper phase containing tar and a lower phase containing said solvent and the remainder of said coal liquefaction product; separating said phases from each other and treating said tar phase with a second solvent to recover asphaltenes, resins and/or aromatics in said tar phase. In copending application, Ser. No. 844,455; filed Oct. 21, 1977, entitled A Process For Separating Tar And Solids From Coal Liquefaction Products Using A Halogenated Aliphatic Solvent, filed concurrently herewith, we define and claim the procedure wherein said lower phase is recovered from said coal liquefaction product to obtain a tar-free coal liquefaction product.

DETAILED DESCRIPTION OF DRAWING

Figure 1:
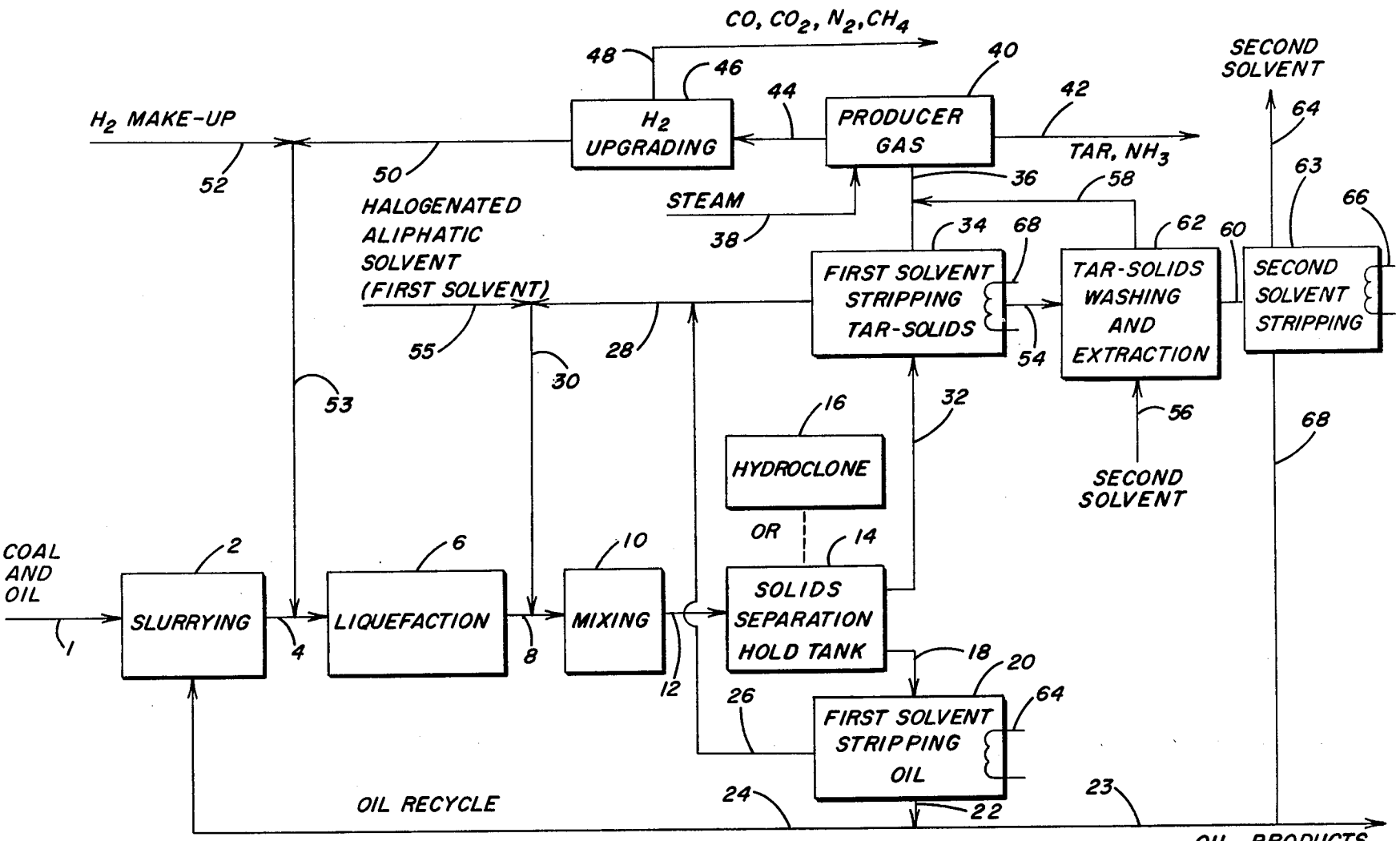

FIG. 1 is a schematic diagram of the process disclosed herein. Crushed coal and oil are introduced through line 1 into slurrying zone 2 where it is mixed with a solvent from line 24 and transferred through line 4 together with hydrogen from line 53, to liquefaction zone 6 containing hydrogenation catalyst. Hydrogen in line 53 is obtained from recycle line 50 and additionally, when required, from make-up line 52. The coal liquefaction product obtained in liquefaction zone 6 as a result of conventional hydrogenation conditions is transferred through line 8 to mixing zone 10 together with a halogenated aliphatic solvent which is introduced into line 8 through lines 55, 28 and 30. The halogenated aliphatic solvent and coal liquefaction product containing tar and/or solid particles are thoroughly mixed and then transported through line 12 to separation zone 14 or hydroclone 16 where the liquefaction product and tar and/or solid particles separate to form a lower phase comprising coal liquefaction product free of tar and/or solids and halogenated aliphatic solvent, and an upper phase comprising tar and/or solid particles and some entrained halogenated aliphatic solvent. The lower phase is withdrawn from separation zone 14 and is transported through line 18 to solvent stripping zone 20, wherein by means of heat exchanger 64, solvent is stripped from the oil and removed by line 26. Oil product is transported through lines 22 and 23 to collection apparatus, while some oil is returned to slurrying zone 2 through oil recycle line 24. The upper phase in separation zone 14, comprising tar and/or solid particles and solvent, is withdrawn and transferred through line 32 to solvent stripping zone 34, wherein by means of heat exchanger 68 solvent is stripped from the tar and/or solid products and recycled through line 28 to line 30 for mixing with coal liquefaction products in mixing zone 10. Tar and solid particles are transported through line 54 to washing and extraction zone 62, a second solvent, for example, benzene, hexane or cyclohexane is introduced through line 56 to said washing and extracting zone 62, where asphaltenes, resins and aromatic compounds are extracted from the tar and transported through line 60 to second solvent stripping zone 63, wherein by means of heat exchanger 66, the second solvent is stripped from the asphaltenes, resins and aromatic compounds and transported through line 64 to collection apparatus. The asphaltenes, resins and aromatic compounds are transported through lines 68 and 23 to upgrading apparatus. The remaining tar and solid particles can be transported through lines 58 and 36 to gas producer zone 40, where steam and free oxygen are introduced through line 38 into gas producer zone 40. In gas producer zone 40, free oxygen reacts exothermally with the tar and solid particles to produce carbon dioxide, carbon monoxide, nitrogen gas, gaseous methane, water vapor and heat. Steam shifts secondary reactions between the gases to hydrogen production. The remaining tar and $NH_3$ are transported through line 42 to collection apparatus; hydrogen gas and other components are transported through line 44 to hydrogen gas upgrading zone 46 where carbon monoxide, carbon dioxide, nitrogen gas and methane are transferred through line 48 to collection apparatus. Hydrogen gas is transported through line 50 to line 53 where it is recycled through line 4 to coal liquefaction zone 6.

DESCRIPTION OF THE PROCESS

In the present invention the yield of fuels produced from a coal liquefaction process is increased by extracting asphaltenes, resins and aromatic compounds from a tar by-product present in the coal liquefaction product produced in the process. The extract can be upgraded to a suitable synthetic fuel using conventional methods. This is accomplished by blending a halogenated aliphatic solvent with a coal slurry liquefaction product which contains tar and unconverted coal and ash in the form of small solid particles. The mixture is next allowed to stand for a few minutes until a phase separation is noted, the two phases can be separated using conventional separation techniques such as filtration, floatation-skimming, centrifugation, settling and the like. The halogenated aliphatic solvent is separated from the tar and solid particles by distillation and a second solvent is added to the tar and solid particles to extract the asphaltenes, resins and aromatic compounds therefrom. The extracted products are then combined with the recovered oil products.

The halogenated aliphatic solvents suitable for use herein preferably are of the formula:

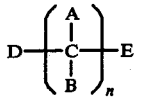

wherein n is an integer of from about 1 to about 20, preferably from about 1 to about 10; and wherein A, B, D and E are either alike or different, members selected from the group consisting of hydrogen, chlorine, bromine or fluorine and mixtures thereof, with the provision that at least one of said A, B, D or E is chlorine, bromine or fluorine.

Halogenated aliphatic solvents suitable for use herein include the following:

Methylfluoride;
Fluoroform;
Chloro-fluoromethane;
Bromo-fluoromethane;
Chloro-difluoromethane;
Chloro-trifluoromethane;
Ethylfluoride;
Difluoroethane;
Bromo-fluoroethane;
2-bromo-1, difluoroethane;
Chloro-trifluoroethane;
Difluoro-di-chloro-ethane;
Trifluoro-di-chloroethane;
Tetrafluoro-di-chloroethane;
1,1,1, chloro-di-fluoroethane;
1,1,1, trifluoroethane;
1,2, Difluoropropane;
1,3, Difluoropropane;
1,2,3, trifluoropropane;
1, bromo-2, fluoropropane;
1, bromo-3, fluoropropane;
Di-chloro-mono-fluoromethane;
Tri-chloro-mono-fluoromethane;
Mono-cloro-mono-bromo-mono-fluoromethane;
Di-bromo-mono-fluoromethane;
Tri-bromo-mono-fluoromethane;
Tetra-chloro-di-fluoromethane;
Tri-bromo-mono-fluoroethane;
Tri-chloro-mono-fluoroethane;
Tetrachloro-mono-fluoroethane;
Tri-chloro-difluoroethane;
Di-bromo-mono-fluoroethane;
Trichloro-trifluoro-ethane;
N-propylfluoride;
Iso-propylfluoride;
N-butylfluoride;
N-amylfluoride;
N-hexyfluoride;
or N-heptylfluoride and mixtures thereof.

An especially desirable halogenated aliphatic solvent suitable for use herein, Freon TF, known under the U.P.A.C. nomenclature system as trichlorotrifluoroethane, is one member of the family of fluorocarbon chemicals developed and commercially marketed by the Du-Pont Company under the well known trademark of Freon. Originally, Freon compounds were developed as refrigerants, however, they presently are widely used as aerosol propellants, solvents, cleaning agents, fire extinguishing agents, dielectric fluids, coolants and relatively stable liquids. Freon compounds are additionally colorless, nonflammable, chemically and thermally inert, free of chemical and physical impurities and they are substantially nontoxic. Previously, Freon TF has been used to remove oil, grease and dirt from objects without harm to metal, plastic or elastomeric parts. Table I below sets forth in greater detail some physical properties of Freon TF.

Table I

| | |
|---|---|
| Molecular Wt. | 187.4 |
| Boiling Point at one atmosphere | 117.6° F (47.6° C) |
| Freezing Point | −31.0° F (−35.0° C) |
| Critical Temperature | 417.4° F (214.1° C) |
| Critical Pressure | 495.0 PSIA (33.7 atm) |
| Density at 77° F (25° C) | 1.565 gm/CM$^3$ |
| Latent Heat of Vaporization at boiling point | 63.12 BTU/lb |
| Viscosity at 70° F (21.1° C) | 0.694 centipoises |
| Surface Tension at 77° F (25° C) | 19.0 dynes/cm |

The growing imbalance between energy consumption, fuel production and the intense concern for environmental conservation has created a need to supplement petroleum derived fuels by the conversion of solid carbonaceous fuels such as coal and other fossil fuel forms into clean burning liquid fuels. It is known that low severity processing is sufficient to convert coal to a low sulfur liquid fuel. Such fuels, however, differ from conventional petroleum-derived fuel oils which are in the same viscosity range. The liquid fuels derived from coal contain tars and solid particles in the form of ash, unreacted and undissolved coal, and the like which are rather difficult and expensive to remove from the synthetic liquid fuels produced. Accordingly, the present invention provides for a very efficient and economical method for removing tars and solid entrained particles from synthetic liquid fuels derived from solid carbonaceous materials, such as coal, using a minimal amount of energy in the process, and additionally allows increasing the yield of synthetic fuel by extracting asphaltenes, resins and aromatic compounds from the tar in said fuel using a second solvent and by subjecting the extracts to conventional cracking and/or other upgrading processes.

Any coal liquefaction product containing tar can be treated in accordance with the procedure defined and claimed herein to increase the fuel value thereof. Coal liquefaction products in the form of synthetic fuels derived from solid carbonaceous products are conveniently prepared by blending finely ground carbonaceous material, such as coal, with a solvent, such as tetralin, decalin, anthracene or the like to form a slurry. The slurry is then introduced into a reaction vessel containing a conventional hydrogenation catalyst and/or hydrogen and is reacted under normal hydrogenating pressures and temperatures. An external source of hydrogen is introduced into the reaction vessel to be used in conjunction with the hydrogenation catalyst, or in the alternative, hydrogen is introduced into the reaction vessel without benefit of a hydrogenation catalyst, for example in a solvent recovery coal process. After hydrogenation, any solids that are present can conveniently be removed from the product stream using the process set-forth herein. The product stream is next stripped of solvent including any residual halogenated aliphatic solvent remaining from the extraction step described above. The stripped product may be fractionated to obtain products of various boiling ranges. Some of these fractionated products are useful as fuels. The remainder can be further upgraded if desired by conventional petroleum processes such as cracking, hydrocracking, and the like.

Synthetic liquid fuels produced from solid carbonaceous products such as coal are primarily aromatic and generally have a boiling range of about 300° F (149° C) to about 1400° F (760° C), a density of about 0.9 to about 1.1 and a carbon to hydrogen molecular ratio in the range of about 1.3:1 to about 0.66:1. A typical example is a solvent oil obtained from a subbituminous coal, such as Wyoming-Montana coal, comprising a middle oil having a boiling range of from about 375° F (190.5° C) to about 675° F (357° C). A description of how to prepare a synthetic fuel from carbonaceous material is set forth in greater detail in U.S. Pat. No. 3,957,619, issued to Chun et al. on May 18, 1976, entitled Process For The Conversion Of Carbonaceous Materials, the disclosure of which is incorporated herein by reference.

Solid carbonaceous materials that can be used herein to obtain the liquid product to be extracted with the halogenated aliphatic solvents preferably are of the following composition on a moisture-free basis:

Table II

| | Weight Percent | |
|---|---|---|
| | Broad Range | Normal Range |
| Carbon | 45 – 95 | 60 – 92 |
| Hydrogen | 2.5 – 7.0 | 4.0 – 6.0 |
| Oxygen | 2.0 – 45 | 3.0 – 25 |
| Nitrogen | 0.75 – 2.5 | 0.75 – 2.5 |
| Sulfur | 0.3 – 10 | 0.5 – 6.0 |

The carbon and hydrogen content of the carbonaceous material will reside primarily in benzene compounds, multiring aromatic compounds, heterocyclic compounds, etc. Nitrogen is believed to be present primarily in chemical combination with the aromatic compounds. Some sulfur and oxygen is believed to be present in chemical combination with the aromatic compounds and some in chemical combination with inorganic elements associated therewith, for example, iron and calcium.

Anthracitic, bituminous and subbituminous coal, lignitic materials, and other types of coal products referred to in ASTM D-388-66 (reapproved 72) are exemplary of the solid carbonaceous materials which can be treated in accordance with the process of the present invention to produce upgraded products therefrom. When a raw coal is employed in the process of the invention, most efficient results are obtained when the coal has a dry fixed carbon content which does not exceed 86 percent and a dry volatile matter content of at least 14 percent by weight as determined on an ash-free basis. The coal, prior to use in the process of the invention, is preferably ground in a suitable attrition machine, such as a hammermill, to a size such that at least 50 percent of the coal will pass through a 40-mesh (U.S. Series) sieve. The ground coal is then dissolved or slurried in a suitable solvent.

Any liquid compound, or mixtures of such compounds, having hydrogen transfer properties can be used as a solvent herein to slurry the crushed coal. However, liquid aromatic hydrocarbons are preferred. By "hydrogen transfer properties" we mean that such compounds can, under the conditions of reaction herein absorb or otherwise take on hydrogen and also release the same. A solvent found particularly useful as a startup solvent is anthracene oil, defined in Chamber's Technical Dictionary, MacMillan, Great Britain, 1943, page 40, as follows: "A coal-tar fraction boiling above 270° C consisting of anthracene, phenanthrene, chrysene, carbazole and other hydrocarbon oils", the teaching of which is incorporated herein by reference. Other solvents which can be satisfactorily employed are those which are commonly used in the Pott-Broche process. Examples of these are polynuclear aromatic hydrocarbons such as naphthalene and chrysene and their hydrogenated products such as tetralin (tetrahydronaphthalene), decalin, etc., or one or more of the foregoing in admixture with a phenolic compound such as phenol or cresol.

Specific examples of carbonaceous slurries suitable for use herein include lignite, anthracene and lignite oil as set forth below in Table III:

Table III

| Elemental Analysis, % by Wt | Lignite | Anthracene Oil | Lignite-Oil (40/60 Slurry) |
|---|---|---|---|
| Carbon | 64.41 | 91.06 | 71.10 |
| Hydrogen | 4.41 | 5.93 | 4.69 |
| Nitrogen | 0.99 | 1.03 | 0.87 |
| Oxygen | 17.42 | 1.50 | 5.35 |
| Sulfur | 0.43 | 0.47 | 0.39 |
| Ash | 12.34 | 0.01 | 3.16 |
| Water | — | — | 14.44 |

Pittsburgh seam coal, anthracene oil and coal oil as set forth below in Table IV:

Table IV

| Elemental Analysis, % by Wt. | Pittsburgh Seam Coal | Anthracene Oil | Coal-Oil (30/70) Slurry |
|---|---|---|---|
| Carbon | 76.84 | 91.25 | 86.93 |
| Hydrogen | 5.06 | 5.98 | 5.70 |
| Nitrogen | 1.61 | 0.95 | 1.15 |
| Oxygen | 8.19 | 1.76 | 3.69 |
| Sulfur | 1.49 | 0.50 | 0.80 |
| Ash | 8.28 | 0.01 | 2.49 |

Kentucky coal, anthracene oil and coal oil as set forth in Table V below;

Table V

| Elemental Analysis % by Wt. | Kentucky Coal | Anthracene Oil | Coal-Oil (30/70) Slurry |
|---|---|---|---|
| Carbon | 68.53 | 91.25 | 82.23 |
| Hydrogen | 4.60 | 5.98 | 5.42 |
| Nitrogen | 1.42 | 0.95 | 1.05 |
| Oxygen | 5.82 | 1.76 | 2.83 |
| Sulfur | 4.63 | 0.50 | 1.64 |
| Ash | 15.00 | 0.01 | 4.51 |
| Water | — | — | 2.32 |

and Wyoming coal, anthracene oil and coal-oil as described in Table VI below; and Table VI

| Elemental Analysis, % by Wt. | Wyoming Coal | Anthracene Oil | Coal-Oil (30/70) Slurry |
|---|---|---|---|
| Carbon | 73.01 | 91.25 | 80.53 |
| Hydrogen | 4.53 | 5.98 | 5.22 |
| Nitrogen | 1.22 | 0.95 | 0.94 |
| Oxygen | 16.31 | 1.76 | 5.03 |
| Sulfur | 0.54 | 0.50 | 0.47 |
| Ash | 4.39 | 0.01 | 1.03 |
| Water | — | — | 6.78 |

The ratio of solvent to solid carbonaceous material can be varied so long as a sufficient amount of solvent is employed to effect conversion of a substantial portion of the solid carbonaceous material in the reaction vessel. While the weight ratio of solvent to solid carbonaceous material can be within the range of about 0.6:1 to about 9:1, a range of about 1:1 to about 4:1 is preferred. Best results are obtained when the weight ratio of solvent to solid carbonaceous material is about 2:1. Ratios of solvent to solid carbonaceous material greater than about 4:1 can be used but provide little significant functional advantage in dissolving or slurrying the solid carbonaceous material for use in the process of this invention. An excessive amount of solvent is undesirable in that added energy or work is required for subsequent separation of the solvent from the system.

Anthracitic, bituminous and subbituminous coal, lignitic materials, and other types of coal products referred to in ASTM D-388 are exemplary of the solid carbonaceous materials which can be treated in accordance with the process of the present invention to produce upgraded products therefrom. Carboniferous materials such as oil shale and tar sands, can also be treated herein in place of the solid carbonaceous materials to obtain similar liquid hydrocarbons. When a raw coal is employed in the process of the invention, most efficient results are obtained when the coal has a dry fixed carbon content which does not exceed 86 percent and a dry volatile matter content of at least 14 percent by weight as determined on an ash-free basis. The coal, prior to use in the process of the invention, is preferably ground in a suitable attrition machine to a size such that at least 50 percent of the coal will pass through a 40-mesh (U.S. Series) sieve. The ground coal is then dissolved or slurried in a suitable solvent. If desired, the solid carbonaceous material can be treated, prior to reaction herein, using any conventional means known in the art, to remove therefrom any materials forming a part thereof that will not be converted to liquid herein under the conditions of reaction.

The selection of a specific solvent when the process of the present invention is initiated is not critical since a liquid fraction which is obtained during the defined conversion process serves as a particularly good solvent for the solid carbonaceous material. The liquid fraction which is useful as a solvent for the solid carbonaceous material, particularly coal, and which is formed during the process, is produced in a quantity which is at least sufficient to replace any solvent that is converted to other products or which is lost during the process. Thus, a portion of the liquid product which is formed in the process of the invention is advantageously recycled to the beginning of the process. It will be recognized that the process continues, the solvent used initially becomes increasingly diluted with the liquid fraction derived from the process until the recycle stream contains essentially none of the original liquid solvent. If the process is operated on a semi-continuous basis, the solvent which is employed at the beginning of each new period may be that which has been obtained from a previous operation. For example, liquids produced from coal in accordance with the present invention are aromatic and generally have a boiling range of about 149° C to about 760° C, a specific gravity of about 0.9 to about 1.1 and a carbon to hydrogen atomic ratio in the range of about 1.5:1 to about 0.66:1. A solvent oil obtained from a subbituminous coal, such as Wyoming-Montana coal, comprises a middle oil having a typical boiling range of about 191° C to about 357° C. Thus, the solvent that is employed herein can broadly be defined as that obtained from a previous conversion of a carbonaceous solid material in accordance with the process defined herein. Although we have used the term "solvent", it is understood that such term covers the liquid wherein the liquid product obtained herein is dissolved as well as the liquid in which the solid materials are dispersed.

In accordance with the present invention, the slurry and hydrogen are maintained at a temperature between about 260° C and about 538° C, at a pressure between about 500 and about 10,000 pounds per square inch absolute (about 35 to about 700 kilograms per square centimeter), and preferably at a pressure between about 1500 and about 4000 psia (about 105 to about 280 kilograms per square centimeter), utilizing a weight hourly space velocity (WHSV) between about 0.25 and about 50 kilograms of solid carbonaceous material per kilogram of catalyst per hour, and added hydrogen in amounts between about 2000 and about 20,000 standard cubic feet (SCF) per barrel (about 356 to about 3560 cubic meters per cubic meter) of slurry. The exact conditions selected will depend, for example, upon the catalyst, the particular charge stock to be treated, and the degree of conversion desired. It is desirable to utilize as low a temperature as possible and still obtain the desired results. This is due to the fact that undesirable side reactions, such as coke formation, are promoted by high temperatures. Thus, if the hydrogenation catalyst is maintained at an unnecessarily high temperature, its effective life is decreased. The hydrogen recycle rate does not vary significantly with various charge stocks and preferably should be between about 2000 and about 10,000 standard cubic feet per barrel (about 356 to about 1780 cubic meters per cubic meter) of slurry.

Any hydrogenation catalyst well-known to those having ordinary skill in the art can be employed herein, but preferably the catalyst which is employed in the process of the invention comprises at least one hydrogenating component selected from the group consisting of the metals, metal sulfides and/or metal oxides of Groups VI and VIII of the Periodic Table. Particularly preferred among the hydrogenating metals are nickel, cobalt, molybdenum and tungsten. Particularly desirable catalysts comprise (a) a combination of about 2 to about 25 percent (preferably about 4 to about 16 percent) by weight molybdenum and at least one of the iron group metals where the iron group metals are present in such amounts that the atomic ratio of the iron group metals with respect to molybdenum is less than about 1.0 and (b) a combination of about 5 to about 40 percent (preferably about 10 to about 25 percent) by weight of nickel and tungsten where the atomic ratio of tungsten to nickel is about 0.1:1 to about 5:1 (preferably about 0.3:1 to about 4:1), said hydrogenating component being composited with a porous support. These Group VI and Group VIII catalysts can employ promoters at levels not in excess of about eight percent, but preferably lower than about five percent. The best promoters are the elements of Groups II and IV. The most preferred one are Ti, Zr, Sr, Mg, Zn and Sn. Catalysts of type "(a)" may contain molybdenum in the amounts conventionally used, i.e., about 2 to about 25 percent molybdenum based on the total weight of the catalyst including the porous carrier. Smaller amounts of molybdenum than about 2 percent may be used, but this reduces the activity. Larger amounts than about 25 percent can also be used but do not increase the activity and constitute an extra expense. The amounts of the iron group metals in "(a)" and "(b)" may be varied as long as the above proportions are used. However, in "(a)" we prefer to utilize two iron group metals, each in an atomic ratio to molybdenum between about 0.1 and about 0.2. All of the iron group metals may be present but we prefer to use only two. However, only one iron group element is employed when a Group IV B promoter is used. The amount of the hydrogenating component based on the metal itself can suitable be from about 0.5 to about 40 percent by weight of the catalyst including the porous carrier, but is usually within the range of about 2 to about 30 percent by weight of the catalyst including the carrier.

When using a catalyst of type "(a)", we prefer to utilize one containing about 4 to about 16 percent by weight molybdenum, most preferably about 8 percent; about 0.2 to about 10 percent by weight nickel, most preferably about 0.5 percent; and about 0.5 to about 5 percent by weight cobalt, most preferably about 1.0 percent. When using a catalyst of type "(b)", we prefer to utilize one containing about 15 to about 25 percent (e.g., about 19 percent) tungsten and about 2 to about 10 percent (e.g., about 6 percent) nickel supported on a catalyst carrier, for example alumina.

In accordance with the present invention a halogenated aliphatic solvent as specifically defined hereinabove, especially trichlorotrifluoroethane, is blended with a coal liquefaction product, substantially as described herein, containing tar and solid particles. The solid particles have diameters within the range of from about 0.1 micron to about 70 microns preferably from about 0.3 micron to about 50 microns. The halogenated aliphatic solvent is blended with the coal liquefaction slurry product in a volume ratio of from about 0.5:1 to about 5:1, preferably from about 1:1 to about 3:1, at any suitable temperature, but preferably room temperature and at any suitable pressure, but preferably atmospheric pressure, for about 0.5 minute to about 60 minutes, preferably from about 1 minute to about 30 minutes. Next the mixture is transported to a separation zone, where a gelatinous appearing phase forms in the mixture. After about 1 to about 5 minutes, preferably about 1 to about 3 minutes, a definite phase separation is noted, with the coal liquefaction product-halogenated aliphatic solvent phase on the bottom and an upper solid, tar-like phase containing solid particles, much larger than the original particles. The top phase, containing virtually all of the original tar and solids and some entrained solvent can be removed by either flotation and skimming, very rapid filtration, contrifugation, and the like. The solvent is readily stripped from the system and recycled using minimum energy due to its very low boiling latent heat of vaporization of from about 30 BTU/lb to about 150 BTU/lb versus that of water, 1002.40 BTU/lb; thus a simple distillation with very little fractionation efficiency is required to give extremely good recovery of the trichlorotrifluoroethane. The distillation can be preferably performed using waste heat generated by the process herein.

The tar/solid particles phase is next blended with a second solvent at a solvent to tar/solid particles ratio of from about 0.5:1 to about 10:1 preferably from about 1:1 to about 5:1 to extract the asphaltenes, resins, aromatic compounds, and other halogenated aliphatic solvent insolubles. Any solvent capable of extracting asphaltenes, resins and aromatic compounds can be used herein, for example, benzene, toluene, N-hexane or cyclohexane and mixtures thereof may be used. Asphaltenes herein are clusters of condensed polyaromatic compounds which contain heteroatoms and form large micelle structures, and which have a molecular weight range of from about 200 to about 25,000, especially from about 500 to about 5000. In greater detail the asphaltenes are characterized by a high number of condensed polycyclic aromatic rings which additionally contain naphthalene and paraffin side chains. Other elements, such as for example, sulfur, nitrogen and/or oxygen atoms and heavy metals such as vanadium and nickel and the like, are normally combined in small proportions in the structures of the condensed polycyclic aromatic rings.

The resins referred to herein are similar to asphaltenes in structure with the exception that the ratio of naphthalene and paraffin side chains to the condensed aromatic rings is greater than that of asphaltenes. It is normally desirable to subject the extracted products to conventional upgrading processes to produce additional valuable synthetic fuel from what would otherwise be regarded as poor quality by-products.

DESCRIPTION OF PREFERRED EMBODIMENT

A coal slurry containing 37 pounds of crushed Big Horn Coal, 59.4 pounds of anthracene oil and 3.6 pounds of a crushed hydrogenation catalyst comprising 3.8% Ni, 5.4% Ti and 10.4% Mo deposited on an alumina support, together with 925 standard cubic feet of hydrogen were subjected to hydrogenation at a temperature of 750° F (398.88° C) and a pressure of 3900 lb/sq.in (274.26 kg/sq.cm) for 0.75 hour to obtain a coal liquefaction product containing 24 pounds of coal liquid, 29.11 pounds of tar and 6.26 pounds of solids. 60 pounds of trichlorotrifluoroethane were added to the coal liquefaction product and the resulting mixture was agitated for 5 minutes. Next, the mixture was allowed to separate into an upper phase comprising tar, solid particles and some entrained trichlorotrifluoroethane and a lower phase comprising coal liquids and trichlorotrifluoroethane. After separation of the two phases, the lower phase was found to contain essentially no tar or solid particles.

The insoluble tar and solids were extracted with a second solvent, for example benzene, toluene, N-hexane or cyclohexane and mixtures thereof. Approximately 25.75 pounds of additional synthetic fuel were produced from the tar and solids extract.

The results of the above process are summarized in Table VII below:

Table VII

| Feed Liquid | Weight (lbs) | |
|---|---|---|
| Solvated Coal Slurry | 100 | (total wt) |
| Big Horn Coal | 37 | |
| Anthracene Oil | 59.4 | |
| Crushed hydrotreating catalyst | 3.6 | |
| Recovered Oil Product plus Solids | 59.37 | |
| *Extracted Oil Recovered | 24 | (total wt) |
| Saturates | 0.768 | |
| Aromatics | 0.312 | |
| Resins | 17.352 | |
| Asphaltenes | 5.568 | |
| Insoluble Tar and Solids | 35.37 | (total wt) |
| Tar | 29.11 | |
| Solids | 6.26 | |
| *Synthetic Fuel Produced FromInsoluble Tar and Solids | 25.75 | |
| *SARA analysis | | |

As can be seen from the foregoing, essentially all of the solid particles in a coal liquefaction product are separated from the liquid synthetic fuel produced and an increase in synthetic fuel is noted. It should additionally be noted that many modifications and variations of the invention, as hereinabove set forth, can be made without departing from the spirit and scope thereof, and therefore only such limitations should be imposed as are indicated in the appended claims.

We claim:

1. A process for increasing the yield of a liquid synthetic fuel in a coal liquefication process which comprises forming a mixture by blending a coal slurry liquefaction product with a halogenated aliphatic solvent of the formula:

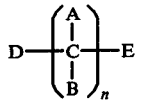

wherein n is an integer of from about 1 to about 20; and wherein A, B, D and E are either alike or different, members selected from the group consisting of hydrogen, chlorine, bromine or fluorine and mixtures thereof, with the provision that at least one of said A, B, D or E is chlorine, bromine or fluorine; allowing the mixture to separate into an upper phase containing tar and a lower phase containing said solvent and the remainder of said coal liquefaction product; separating said phases from each other and treating said tar phase with a second solvent selected from the group consisting of benzene, n-hexane, cyclohexane or toluene and mixtures thereof, to recover asphaltenes, resins and/or aromatics in said tar phase.

2. The process of claim 1 wherein n is an integer of from about 1 to about 10.

3. The process of claim 1 wherein the halogenated aliphatic solvent is a member selected from the group consisting of:

Methylfluoride;
Fluoroform;
Chloro-fluoromethane;
Bromo-fluoromethane;
Chloro-difluoromethane;
Chloro-trifluoromethane;
Ethylfluoride;
Difluoroethane;
Bromo-fluoroethane; 2-bromo-1, difluoroethane;
Chloro-trifluoroethane;
Difluoro-di-chloro-ethane;
Trifluoro-di-chloroethane;
Tetrafluoro-di-chloroethane;
1,1,1, chloro-di-fluoroethane;
1,1,1, trifluoroethane;
1,2, Difluoropropane;
1,3, Difluoropropane;
1,2,3, trifluoropropane;
1, bromo-2, fluoropropane;
1, bromo-3, fluoropropane;
Di-chloro-mono-fluoromethane;
Tri-chloro-mono-fluoromethane;
Mono-cloro-mono-bromo-mono-fluoromethane;
Di-bromo-mono-fluoromethane;
Tri-bromo-mono-fluoromethane;
Tetra-chloro-di-fluoromethane;
Tri-bromo-mono-fluoroethane;
Tri-chloro-mono-fluoroethane;
Tetrachloro-mono-fluoroethane;
Tri-chloro-difluoroethane;
Di-bromo-mono-fluoroethane;
Trichloro-trifluoro-ethane;
N-propylfluoride;
Iso-propylfluoride;

N-butylfluoride;
N-amylfluoride;
N-hexyfluoride;
or N-heptylfluoride and mixtures thereof.

4. The process of claim 1 wherein the halogenated aliphatic solvent is trichlorotrifluoroethane.

5. The process according to claim 1 wherein the halogenated aliphatic solvent is blended with the coal liquefaction product in a volume ratio range of from about 0.5:1 to about 5:1.

6. The process according to claim 1 wherein the halogenated aliphatic solvent is blended with the coal liquefaction product in a volume ratio range of from about 1:1 to about 3:1.

7. The process of claim 1 wherein the halogenated aliphatic solvent is blended with the coal liquefaction product for about 0.5 minute to about 60 minutes.

8. The process of claim 1 wherein the halogenated aliphatic solvent is blended with the coal liquefaction product for about 1 minute to about 30 minutes.

9. The process of claim 1 wherein the two phases are separated from each other by floatation and skimming.

10. The process of claim 1 wherein the two phases are separated from each other by rapid filtration.

11. The process of claim 1 wherein the two phases are separated from each other by centrifugation.

12. The process of claim 1 wherein the halogenated aliphatic solvent is separated from the tar and coal liquefaction product by distillation.

13. The process of claim 1 wherein the second solvent is added to the tar in a ratio range of from about 0.5:1 to about 10:1.

14. The process of claim 1 wherein the second solvent is added to the tar in a ratio range of from about 1:1 to about 5:1.

* * * * *